US009555311B1

(12) United States Patent
Mustafa

(10) Patent No.: US 9,555,311 B1
(45) Date of Patent: Jan. 31, 2017

(54) PROTECTIVE OVERGARMENT

(71) Applicant: Ibtesam M. Y. Mustafa, Khaldiya (KW)

(72) Inventor: Ibtesam M. Y. Mustafa, Khaldiya (KW)

( * ) Notice: Subject to any disclaimer, the term of this patent is extended or adjusted under 35 U.S.C. 154(b) by 0 days.

(21) Appl. No.: 15/097,272

(22) Filed: Apr. 12, 2016

(51) Int. Cl.

| | |
|---|---|
| ***A63B 71/08*** | (2006.01) |
| ***A41D 27/28*** | (2006.01) |
| ***A41D 13/06*** | (2006.01) |
| ***A41D 13/05*** | (2006.01) |
| ***A41D 31/00*** | (2006.01) |

(52) U.S. Cl.
CPC ..... *A63B 71/081* (2013.01); *A41D 13/0512* (2013.01); *A41D 13/0518* (2013.01); *A41D 13/065* (2013.01); *A41D 27/28* (2013.01); *A41D 31/005* (2013.01)

(58) Field of Classification Search
CPC ..... A63B 71/081; A41D 13/0512; A41D 13/0518; A41D 31/005; A41D 27/28; A41D 13/065
See application file for complete search history.

(56) References Cited

U.S. PATENT DOCUMENTS 1,144,150 A 6/1915 Marcovsky
1,657,866 A 1/1928 Mooney
3,186,004 A * 6/1965 Carlini ..... A42B 3/122 2/413
3,454,963 A * 7/1969 Palladino ..... A41D 13/0568 2/24
3,594,817 A * 7/1971 Kelly ..... A41D 13/015 2/16
3,945,042 A * 3/1976 Lobo ..... A41D 13/0156 2/16
4,068,323 A * 1/1978 Gwon ..... A42B 3/06 2/413
4,095,294 A * 6/1978 Winterbottom ..... A63B 71/145 2/18
D255,056 S 5/1980 Parsons
4,213,202 A * 7/1980 Larry ..... A41D 31/005 2/456
4,343,047 A * 8/1982 Lazowski ..... A42B 3/125 2/411
4,451,934 A * 6/1984 Gioello ..... A41B 9/00 2/113
4,484,364 A * 11/1984 Mitchell ..... A42B 3/124 2/413
4,825,469 A 5/1989 Kincheloe
(Continued)

*Primary Examiner* — Khaled Annis
(74) *Attorney, Agent, or Firm* — Richard C. Litman

(57) ABSTRACT

The protective overgarment is intended for use by persons who engage in potentially hazardous activities, such as motorcycling and mountaineering. The overgarment is formed of generally circumferential elements that extend around the legs, torso, and arms of the wearer. The circumferential elements are connected by a plurality of connecting elements that extend along the sides of the torso and limbs of the wearer. The elements define corresponding open ventilation passages therebetween, providing greater comfort for the wearer during warm weather. Each of the elements is formed of at least one distinct layer. One layer may be a sheet of resilient rubber or the like. Another layer may be pneumatically inflated or filled with foam plastic material. Yet another layer may also be foam-filled and covered with a stretch fabric for comfort. Additional knee, shoulder, and chest protection is provided by removable rigid plates.

18 Claims, 6 Drawing Sheets

(56) References Cited

U.S. PATENT DOCUMENTS

| | | | | |
|---|---|---|---|---|
| 5,014,363 | A * | 5/1991 | Hubner | A41D 19/0055 2/200.1 |
| 5,091,992 | A | 3/1992 | Pusic | |
| 5,515,543 | A * | 5/1996 | Gioello | A41D 27/28 2/69 |
| 5,530,966 | A * | 7/1996 | West | A61K 38/162 2/2.5 |
| 5,546,602 | A * | 8/1996 | Hale | A41D 13/0155 128/874 |
| 5,893,175 | A * | 4/1999 | Cooper | A41D 13/0155 2/462 |
| 6,543,054 | B2 | 4/2003 | Gabriel | |
| 6,766,535 | B2 | 7/2004 | Duhamell et al. | |
| 8,011,019 | B1 | 9/2011 | Hamid et al. | |
| 9,032,549 | B1 * | 5/2015 | Cameron | A42B 3/122 2/171.3 |
| 2005/0029418 | A1 * | 2/2005 | Lee | A41D 27/28 248/214 |
| 2006/0101553 | A1 | 5/2006 | Aspray | |
| 2008/0244801 | A1 * | 10/2008 | Russo | A41D 13/0543 2/22 |
| 2016/0095361 | A1 * | 4/2016 | Carmack | A41D 13/0512 2/462 |
| 2016/0113339 | A1 * | 4/2016 | Dolcetti | A41D 31/0016 2/69 |

* cited by examiner

PROTECTIVE OVERGARMENT

BACKGROUND OF THE INVENTION

1. Field of the Invention

The present invention relates generally to protective clothing and the like, and particularly to a protective overgarment for use by motorcyclists, motorsports participants, rock climbers, and others engaged in potentially hazardous activities.

2. Description of the Related Art

The need has long been recognized for protective accessories for participants engaged in various activities where they are exposed to potential injury. Perhaps the most recognized of these activities is motorcycle riding, where the exposed rider is subject to injuries ranging from abrasion to fractures and internal organ damage in the event of an accident. Much the same may be said of persons engaged in other extreme sports, such as mountaineering, motorsports, and other activities involving bodily exposure and/or high speeds.

Accordingly, a vast number of different protective accessories have been developed for use in such activities, most being rather specialized for a particular activity. Helmets are nearly universally required in motorsports. Such helmets are configured to meet various safety standards that depend upon the governing authority. While such helmets provide excellent protection for the head in all but the most extreme accidents, they do nothing for the rest of the body. Various fire-resistant suits and overgarments have been developed for use in motorsports, as well as for firefighters and others who are confronted with extreme heat from time to time. However, such fire-resistant suits and overgarments do not provide any greater protection from impact and abrasion than that provided by standard clothing.

While various synthetic and manufactured materials have been developed for use as protective clothing, many experts still feel that natural leather provides the best protection against abrasion and minor injury for motorcyclists and others engaging in relatively high risk activities. "Leathers" for motorcyclists are well known, and include leather pants, jackets, and gloves. While the tough, durable leather material does provide good protection from abrasion, it is relatively thin and cannot provide a great deal of impact protection. Moreover, the continuous, unbroken coverage provided by such material precludes ventilation for the wearer, and is uncomfortable on a day of even moderate temperature. Indeed, cases are on record of drivers in motorsports events suffering from heat stroke due to the extreme temperatures encountered on summer days in a racing event, while wearing a full coverage fire protection suit.

Thus, a protective overgarment solving the aforementioned problems is desired.

SUMMARY OF THE INVENTION

The protective overgarment is intended for wear by anyone who may engage in a potentially hazardous activity exposing the participant to potential physical injury, such as motorcycle riding, mountaineering, and other similar activities. The protective overgarment includes a large number of flexible circumferential elements configured to extend around the torso, legs, and arms of the wearer of the overgarment. The various elements are connected to one another by additional elements that extend generally along the sides of the torso and limbs of the wearer. The elements define a series of open ventilation passages therebetween to provide greater comfort for the wearer in warm weather.

Each of the elements can include one or more layers to provide impact protection to the user. For example, each of the circular elements and each of the connecting elements can include a layer including elastomeric protrusions or bumps, a layer including a flexible cover defining an interior volume, a layer including a foam-filled core surrounded by a stretch fabric cover, and/or a layer including resilient springs. In an exemplary embodiment, each of the elements is formed of three layers of material. The outermost layer comprises a rubber or plastic sheet having a textured outer surface, e.g., protrusions or bumps. The middle layer comprises a hollow flexible tube that may be pneumatically inflated or filled with a resilient foam plastic material or the like. The overgarment is passively configured, in that the tubes of the pneumatically inflated embodiment are inflated prior to use and remain inflated whether or not the wearer and suit are subjected to an accident or the like. The innermost layer is also foam-filled, and has a stretch fabric covering for comfort for the wearer of the overgarment. Additional resilience may be provided by adding a large number of small spiral springs between the foam layer and outer pneumatic layer, in some embodiments. Further protection may be provided by a large number of small buttons or spikes formed of resilient material (e.g., rubber, etc.) that extend from the outer surface of the suit. Alternatively, one or more of these various layers may be deleted as desired.

Additional protection may be provided by hard, rigid plates that cover the knees, chest, and shoulders. A narrow elongate spinal protective element may also be provided. The various plates are removably attached to the remainder of the suit for incorporation and use as desired, while the spinal protective element remains permanently attached along the back of the suit. The general structure and configuration used in the construction of the overgarment may also be used to cover an otherwise conventional helmet and to form overshoes or overboots as well.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The protective overgarment provides significantly improved impact and abrasion protection for persons engaged in various motorsport activities and other potentially hazardous sports such as mountaineering, rock climbing, and the like. However, rather than completely enclosing the torso and limbs of the wearer and thereby precluding air circulation and ventilation, the protective overgarment is structured to provide relatively large areas or passages between the various protective elements to allow relatively free air circulation about the torso and limbs of the wearer. The protective overgarment may also include protective covering for the helmet and/or boots or shoes worn by the wearer of the overgarment, or may comprise a partial covering, e.g., just for the arm(s) and/or the leg(s).

Figure 1:
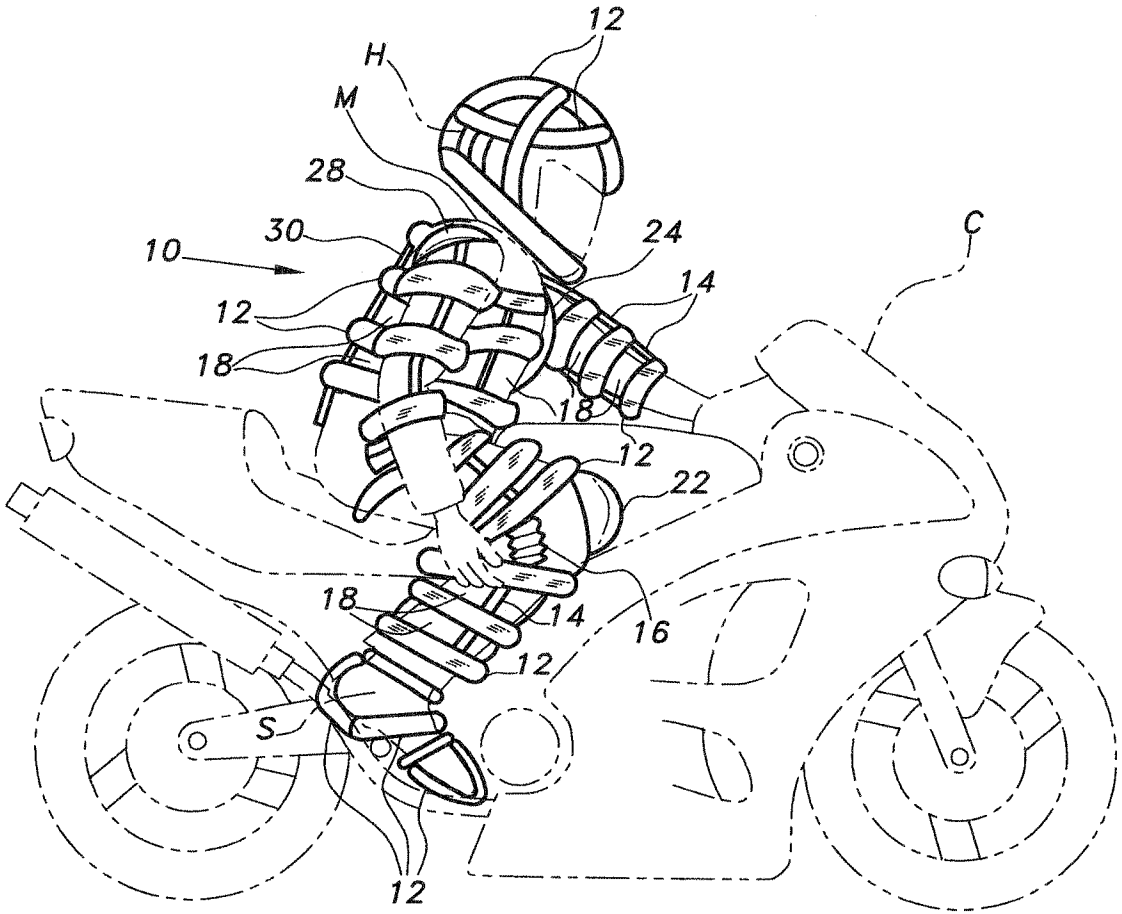
FIG. 1 is an environmental, side elevation view of a motorcyclist wearing a protective overgarment according to the present invention, while riding a motorcycle.
Figure 2:
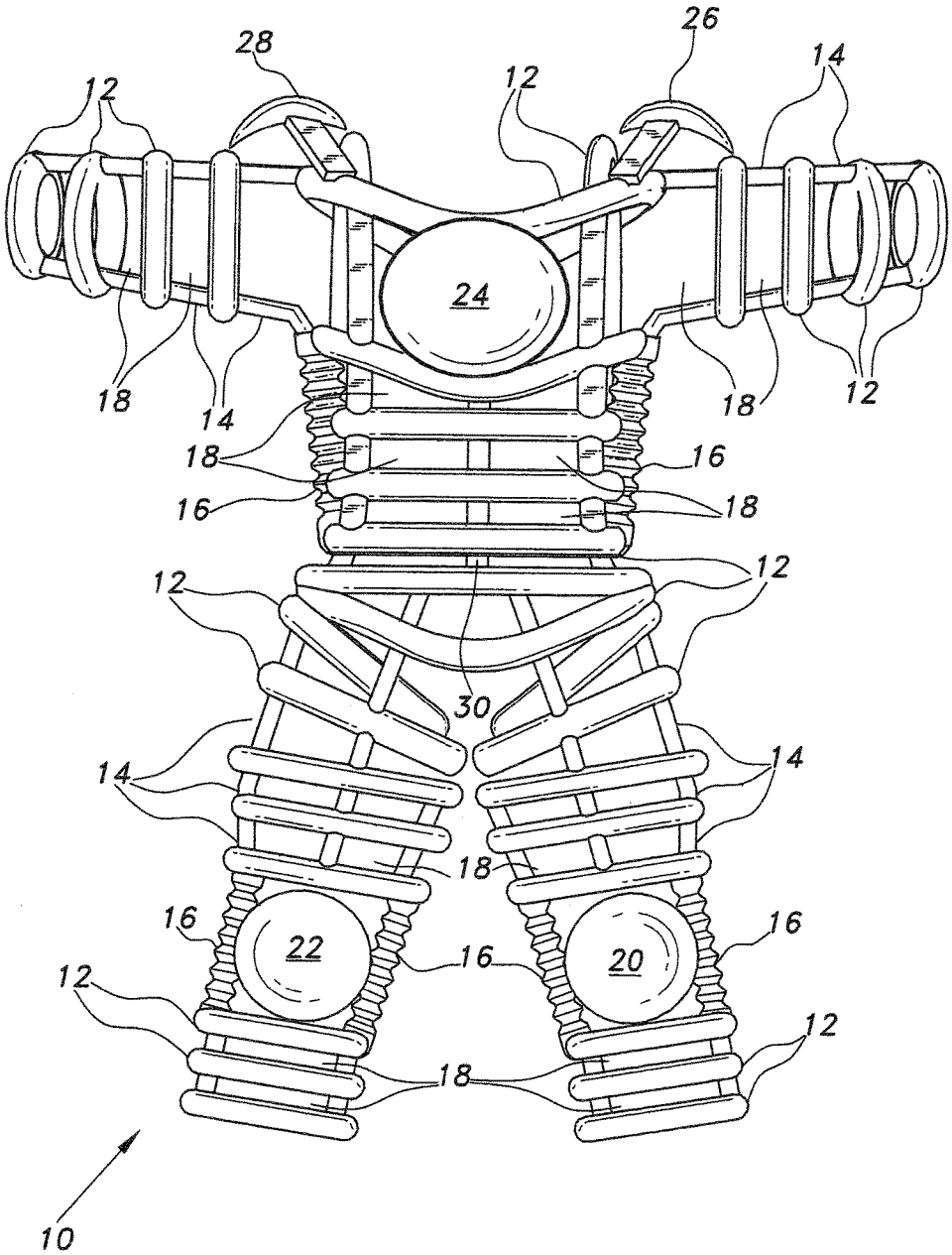
FIG. 2 is a front elevation view of a first embodiment of a protective overgarment according to the present invention, illustrating various features thereof.
Figure 3:
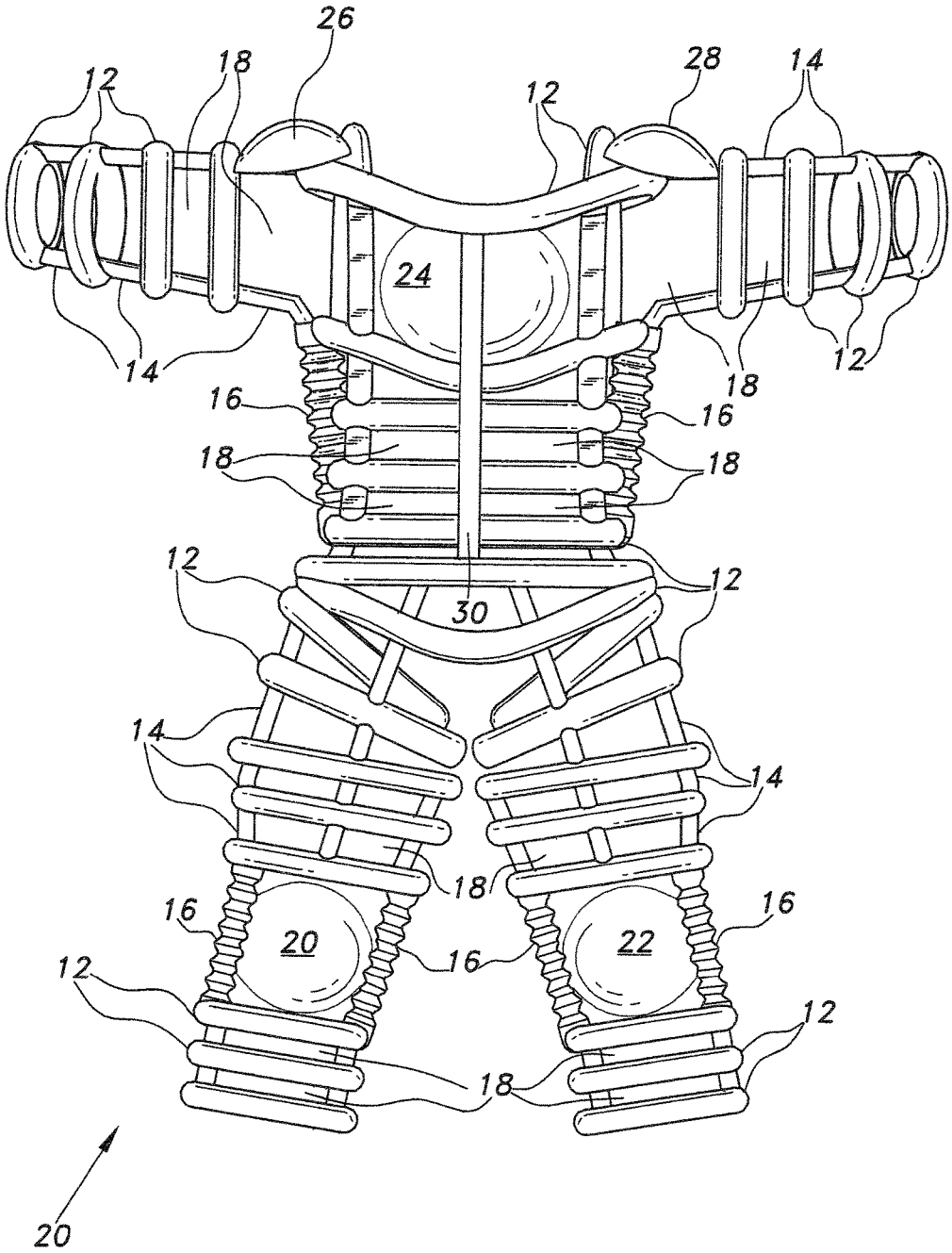
FIG. 3 is a rear elevation view of the protective overgarment embodiment of FIG. 1, illustrating further features thereof.

FIG. 1 of the drawings provides an environmental view of a motorcyclist M wearing a first embodiment of the protective overgarment 10 while riding a motorcycle C. FIGS. 2 and 3 provide front and rear elevation views of the overgarment 10. The overgarment 10 of FIGS. 1 through 3 comprises a unitary structure. The torso, leg, and arm elements are all permanently joined and/or assembled either directly or indirectly to one another. The overgarment 10 is constructed using a plurality (i.e., two or more) of elongate, flexible, resilient or cushioned tubular elements 12, each of which has a generally circular or annular configuration to surround some portion of the body of the wearer, i.e., the torso, legs, or arms. The tubular elements 12 are substantially identical to one another, except that their lengths are adapted to fit comfortably about a given portion of the wearer's body. Substantially the same elements 12 may also be formed to fit about the helmet H and around the boots or shoes S of the wearer, as well.

Additional connecting elements 14 and 16 extend generally longitudinally along portions of the torso, leg, and arm components, and serve to connect the generally circular tubular elements 12 with one another. The first connecting elements 14 are configured similar to the circular elements 12, i.e., with reasonable flexibility, but as the portions of the body over which they extend do not flex appreciably, they need not be constructed to have exceptional flexibility. The second connecting elements 16 are also formed as elongate, flexible, resilient tubular structures, but have corrugated or "accordion fold" external outer coverings to provide greater flexibility. These externally corrugated elements 16 are installed along the sides of various body joints and structures where some appreciable bending and flexing occurs, i.e., along the sides of each knee and along the sides of the torso. They may also be provided along the sides of each elbow joint when the arm portions of the overgarment 10 extend along the arms beyond the elbows.

The lengths of the connecting elements 14 and 16 are sufficient to space the various generally circular elements 12 apart from one another. Adjacent elements 12 define relatively large ventilation passages 18 therebetween. Thus, a person wearing the protective overgarment 10 or any of its other embodiments will be provided with airflow through the large ventilation passages 18 to provide comfort in warmer weather, particularly if the person is riding an open vehicle at speed or is otherwise subjected to wind or airflow.

Additional protection for the wearer is provided by relatively rigid protective plates removably installed at certain critical locations on the overgarment 10. The plates illustrated in FIGS. 1 through 3 comprise left and right knee plates 20 and 22, a chest protective plate 24, and left and right shoulder plates 26 and 28. Additional plates may be provided for other areas of the body, e.g., elbow plates, etc. The various plates 20 through 28 may be formed with a rigid, hard exterior shell of stiff leather, glass fiber composite, hard plastic, or other suitable material. The interior surface of each plate, i.e., the surface in contact with the conventional apparel of the wearer, is preferably formed of substantially the same material as the various tubular circular and connecting elements 12 through 16. The plates 20 through 28 are removably attached to the appropriate areas of the protective overgarment 10 by conventional means, e.g., hooks and eyes, etc. Additional spinal protection may be provided by an elongate spinal protection plate 30 having substantially the same construction as the other plates 20 through 28.

Figure 4:
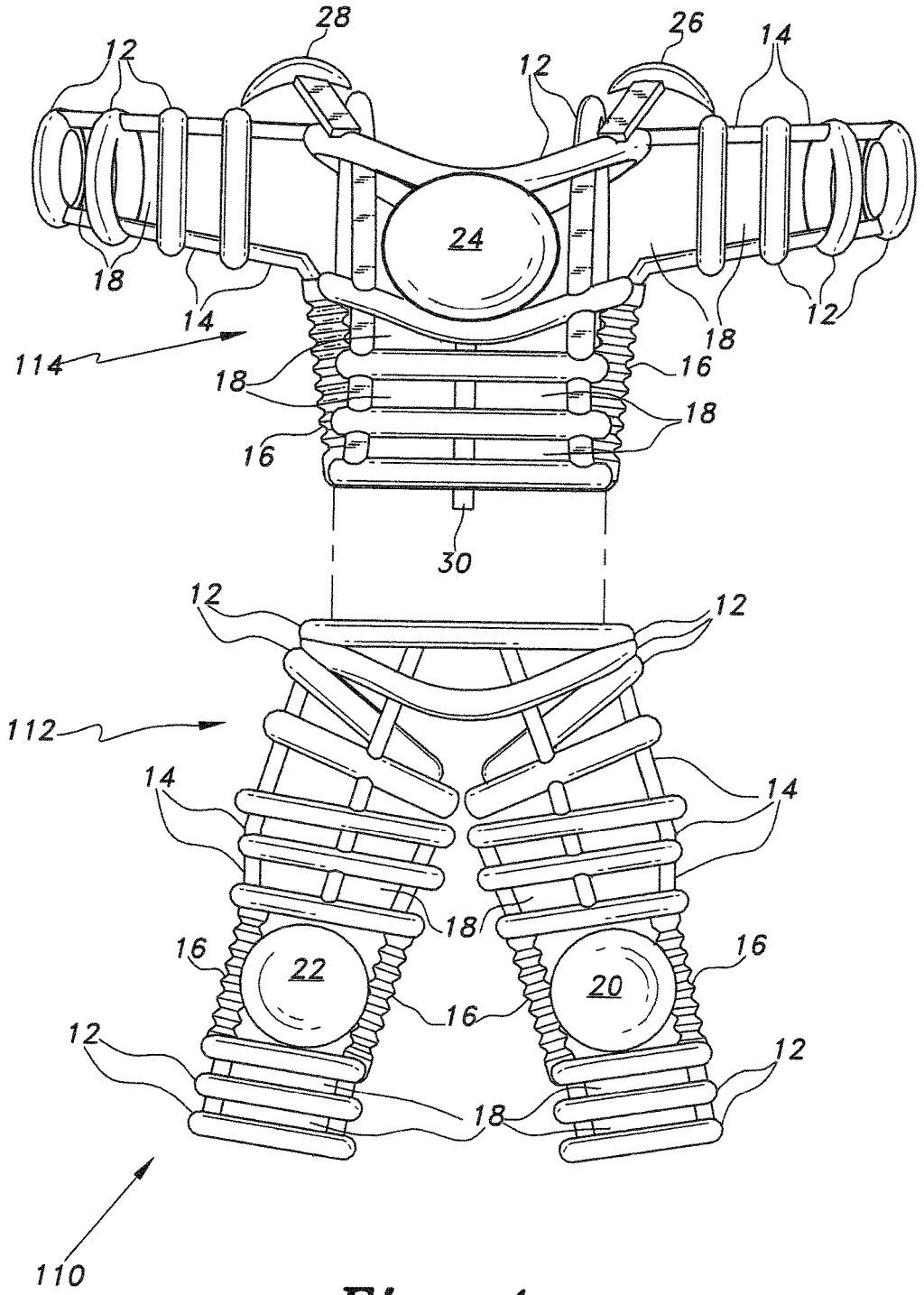
FIG. 4 is a front elevation view of an alternative embodiment of a protective overgarment according to the present invention, wherein the overgarment is provided as a lower component covering the legs and lower body up to the waist and a separate upper component covering the torso and arms.

FIG. 4 provides a front elevation view of an alternative embodiment of the protective overgarment, designated as protective overgarment 110. The overgarment 110 is constructed in essentially the same manner as the overgarment 10 of FIGS. 1 through 3, i.e., having generally circular tubular elements 12 and connecting elements 14 and 16 defining ventilation passages 18, and various protective plates 20 through 30. However, the protective overgarment 110 is formed in two separate sections or pieces, having a lower section or piece 112 that covers both legs and extends to approximately the waist when worn, and an upper section or piece 114 that covers the torso and arms when worn. The two sections or pieces 112 and 114 may be connected to one another by using conventional connectors, e.g., hooks and eyes, mating hook and loop fabric material, etc.

Figure 5:
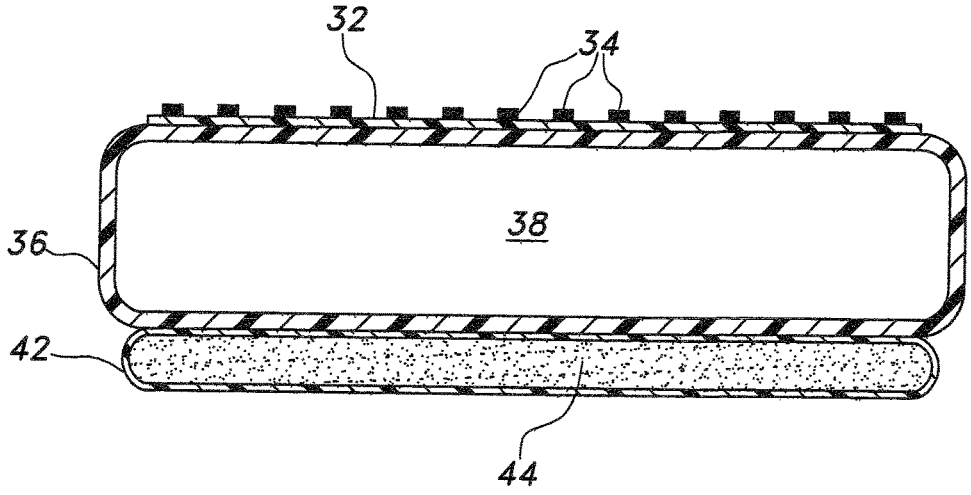
FIG. 5 is a transverse section view through the material of the protective overgarment according to the present invention, wherein the central layer of the element comprises a pneumatically inflatable tube.
Figure 6:
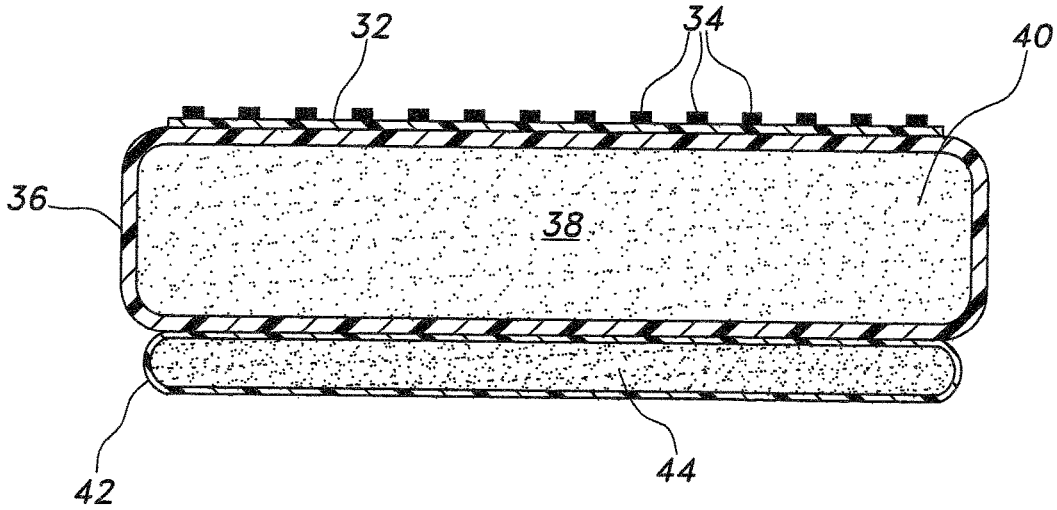
FIG. 6 is a transverse section view through one of the circumferential elements of the material in an alternative embodiment of the protective overgarment according to the present invention, wherein the central layer of the element comprises a foam plastic filled tube.

FIGS. 5 and 6 provide cross-sectional views through two different embodiments of the tubular and connecting elements. The two embodiments differ from one another only in the material used to fill the central or middle layer. Each is formed of an outer layer or sheet 32 of an elastomer material, such as natural or synthetic rubber. The outer surface can be textured, e.g., including small protrusions or bumps 34 to provide better texture for the material. The middle or central layer 36 comprises a closed cover of flexible material defining an interior volume 38. The closed cover of the central layer 36 is preferably formed of a substantially gas-impervious material, such as plastic sheet or the like, particularly for the embodiment of FIG. 5. The two element embodiments shown in FIGS. 5 and 6 differ only in the material used to fill this interior volume. The embodiment of FIG. 5 is inflated pneumatically by air or other gas, and the embodiment of FIG. 6 is filled with a foam plastic material 40 or the like. The inner layer 42, i.e., the layer in contact with the conventional apparel of the wearer of the overgarment, comprises a cover of stretch fabric material (e.g., cotton knit, etc.) filled with a soft, resilient foam core material 44 in its core. The various layers may be bonded or otherwise permanently attached to one another to form the completed tubular and connecting elements.

The somewhat flattened cross sections of the tubular and connecting elements shown in FIGS. 5 and 6 are exemplary.

This construction may be used, or taller and narrower layers may be assembled to form elements having substantially the same height and width. The cross-sectional shapes of the layers may be adjusted to form elements having circular cross sections, generally as shown in FIGS. 2 through 4, when the layers are assembled. Other cross-sectional shapes may be developed according to the cross-sectional shapes of the individual layers. Regardless of the specific cross-sectional shape and materials of the various tubular circular and connecting elements, the additional protection and comfort provided by the protective overgarment will be greatly appreciated by those who engage in various motorsports and/or other extreme sports.

Figure 7:
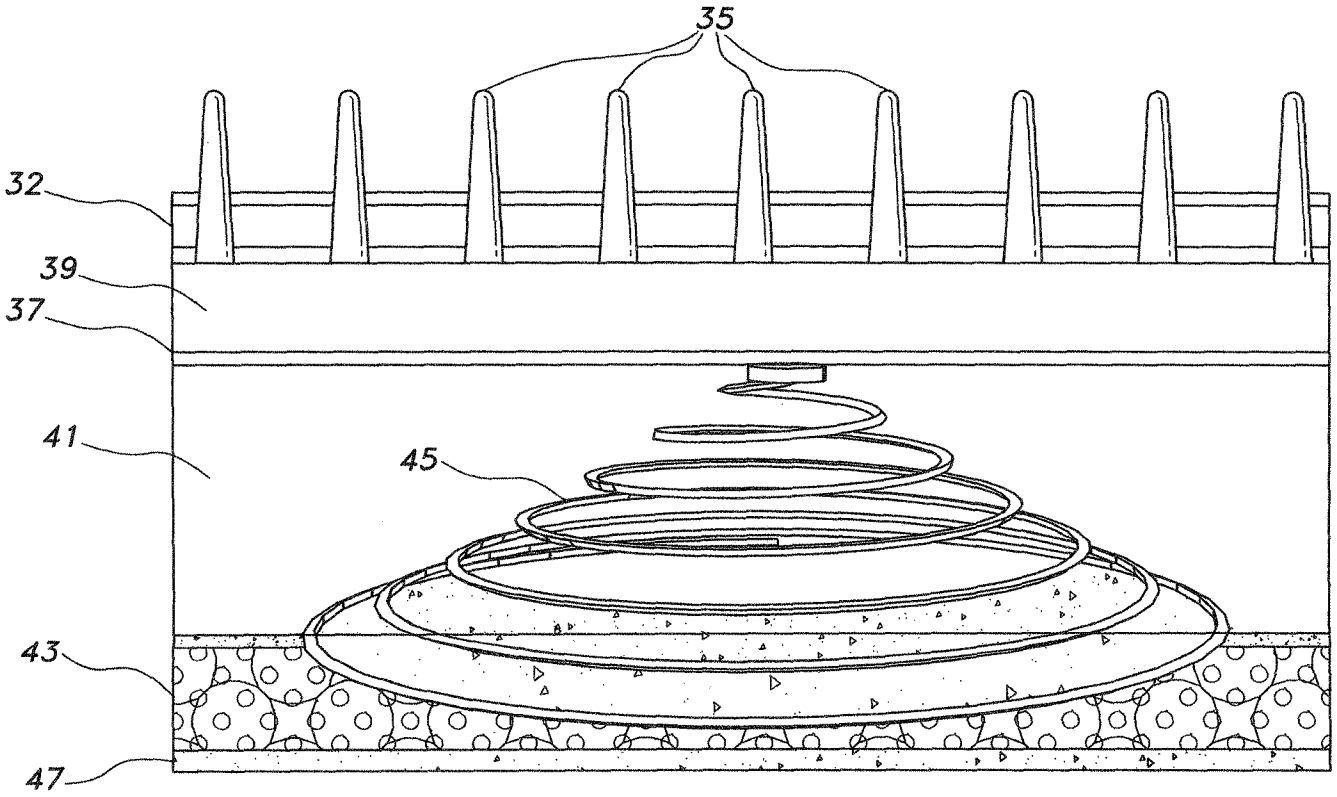
FIG. 7 is an enlarged diagrammatic elevation view in section through one of the elements of another alternative embodiment of the protective overgarment according to the present invention, incorporating coiled springs disposed internally between plies of material and spikes of resilient material extending from the outer layer.

FIG. 7 of the drawings provides an elevation view in section of another alternative construction for the tubular structure of the protective overgarment. The detail of the tubular structure embodiment illustrated in FIG. 7 includes an outer layer or sheet 32 of an elastomer material, such as natural or synthetic rubber. The outer surface can be textured, e.g., including a large number of small spikes 35 of resilient material extending therefrom. It will be seen that these spikes 35 could be incorporated with the embodiments of FIGS. 5 and/or 6 in lieu of the shorter resilient bumps or protrusions 34 described further above, or those resilient bumps or protrusions 34 may be incorporated with the protective structure illustrated in FIG. 7. The second layer 37 below the outermost layer 32 comprises a closed cover of flexible material defining an interior volume 39. The closed cover of the second layer 37 is preferably formed of a substantially gas-impervious material, such as plastic sheet or the like, particularly for the embodiment of FIG. 7. The embodiment of FIG. 7 may be inflated pneumatically by air or other gas as in the embodiment of FIG. 5, or may be filled with a foam plastic material or the like, as in the embodiment of FIG. 6.

Proceeding from the outermost layer toward the innermost layer, the next layer 41 is also a hollow volume defined by the impervious cover 37 and a third layer or ply 43 of foam material essentially identical to the foam material 44 used in the embodiments of FIGS. 5 and 6. This hollow layer 41 incorporates a number of conically tapered coiled springs 45 captured between the layer or ply 43 and the overlying layer or ply 37. While only a single spring is illustrated in the enlarged detail view of FIG. 7, it will be understood that extension of this illustrated structure to either side of that shown in FIG. 7 will present substantially the same continuing structure. The springs 45 may be formed of a corrosion-resistant material, such as plastic, or a corrosion-resistant metal (e.g., stainless steel, etc.). The springs 45, in combination with the resilient pneumatic volume 39 thereabove, the resilient foam material 43 therebelow, and the resilient spikes or protrusions 35, provide an extremely resilient composite structure to absorb impact forces. The bottom or inner surface of the foam layer 43 is preferably covered with a layer of soft cotton fabric material 47, which is in contact with the skin or underlying clothing of the wearer when the protective overgarment is being worn. As in the case of the other embodiments described further above, the various layers may be bonded or otherwise permanently attached to one another to form the completed tubular and connecting elements. Thus, the embodiment of FIG. 7 may be arranged to include a plurality of layers comprising (1) the outer spikes 35, (2) the spike supporting layer 32, (3) the resilient pneumatic volume or layer 39, (4) the hollow layer 41 with its spring (or other resilient means) 45, (5) the layer or ply supporting the springs 45, and (6) the innermost layer 47 of soft material. These various layers (1) through (6) may be combined or deleted as desired.

It is to be understood that the present invention is not limited to the embodiments described above, but encompasses any and all embodiments within the scope of the following claims.

I claim:

1. A protective overgarment, comprising:

a plurality of elongate, flexible, resilient, generally circular elements, the circular elements collectively forming at least one article of apparel for covering at least a portion of the body of a wearer;

a plurality of elongate, flexible, resilient connecting elements, the connecting elements connecting the circular elements to one another, the circular elements and the connecting elements defining a corresponding plurality of ventilation passages therebetween; and a plurality of at least five removably attached rigid protective plates including a left knee plate, a right knee plate, a chest plate, a left shoulder plate, and a right shoulder plate;

wherein the plurality of at least five plates forming an additional rigid protection to the at least one article of apparel.

2. The protective overgarment according to claim 1, wherein each of the circular elements and each of the connecting elements comprises at least one layer selected from the group consisting of:

a layer including an elastomeric sheet material having a textured outer surface, a layer including a flexible cover defining an interior volume, a layer including a foam-filled core surrounded by a stretch fabric cover, and a layer including resilient springs enclosed therein.

3. The protective overgarment according to claim 2, wherein the flexible cover defining the interior volume includes a tube adapted for being pneumatically inflated.

4. The protective overgarment according to claim 2, wherein the flexible cover defining the interior volume includes a foam plastic material in the interior volume.

5. The protective overgarment according to claim 1 wherein the at least one article of apparel comprises a single, unitary article having all of the circular elements and all of the connecting elements joined to one another.

6. The protective overgarment according to claim 1, wherein the at least one article of apparel comprises a lower portion adapted to enclose the legs and hip area and an upper portion separate from the lower portion, the upper portion being adapted to cover the torso and arms.

7. A protective overgarment, comprising:

a plurality of elongate, flexible, resilient, generally circular elements, the circular elements collectively forming at least one article of apparel for covering at least a portion of the body of a wearer;

a plurality of elongate, flexible, resilient connecting elements, the connecting elements connecting the circular elements to one another, each of the circular elements and each of the connecting elements having at least one layer selected from the group consisting of:

a layer including an elastomeric sheet material having a textured outer surface, a layer including a flexible cover defining an interior volume, a layer including a foam-filled core surrounded by a stretch fabric cover, and a layer including resilient springs enclosed therein; and a plurality of at least five removably attached rigid protective plates including a left knee plate, a right knee plate, a chest plate, a left shoulder plate, and a right shoulder plate;

wherein the plurality of at least five plates forming an additional rigid protection to the at least one article of apparel.

8. The protective overgarment according to claim 7, wherein the circular elements and the connecting elements define a corresponding plurality of ventilation passages therebetween.

9. The protective overgarment according to claim 7, wherein the flexible cover defining the interior volume includes a tube adapted for being pneumatically inflated.

10. The protective overgarment according to claim 7, wherein the flexible cover defining the interior volume includes a foam plastic material in the interior volume.

11. The protective overgarment according to claim 7 wherein the at least one article of apparel comprises a single, unitary article having all of the circular elements and all of the connecting elements joined to one another.

12. The protective overgarment according to claim 7, wherein the at least one article of apparel comprises a lower portion adapted to enclose the legs and hip area and an upper portion separate from the lower portion, the upper portion being adapted to cover the torso and arms.

13. A protective overgarment, comprising:

a plurality of elongate, flexible, resilient, generally circular elements, the circular elements collectively forming at least one article of apparel for covering at least a portion of the body of a wearer;

a plurality of elongate, flexible, resilient connecting elements, the connecting elements connecting the circular elements to one another; and a plurality of at least five removably attached rigid protective plates, the plates including a left knee plate, a right knee plate, a chest plate, a left shoulder plate, and a right shoulder plate;

wherein the plurality of at least five plates forming additional rigid protection to the at least one article of apparel.

14. The protective overgarment according to claim 13, wherein the circular elements and the connecting elements define a corresponding plurality of ventilation passages therebetween.

15. The protective overgarment according to claim 13, wherein each of the circular elements and each of the connecting elements comprises at least one layer selected from the group consisting of;

a layer including an elastomeric sheet material having a textured outer surface, a layer including a flexible cover defining an interior volume, a layer including a foam-filled core surrounded by a stretch fabric cover, and a layer including resilient springs enclosed therein.

16. The protective overgarment according to claim 15, wherein the flexible cover defining the interior volume includes air or a foam plastic material in the interior volume.

17. The protective overgarment according to claim 13 wherein the at least one article of apparel comprises a single, unitary article having all of the circular elements and all of the connecting elements joined to one another.

18. The protective overgarment according to claim 13, wherein the at least one article of apparel comprises a lower portion adapted to enclose the legs and hip area and an upper portion separate from the lower portion, the upper portion being adapted to cover the torso and arms.

* * * * *